US009810046B2

(12) United States Patent
Songire et al.

(10) Patent No.: US 9,810,046 B2
(45) Date of Patent: Nov. 7, 2017

(54) SCREEN PACKER ASSEMBLY

(71) Applicant: Halliburton Energy Services, Inc., Houston, TX (US)

(72) Inventors: Sumit Ramesh Songire, Pune Maharashtra (IN); Amit Chandrakant Agrawal, Pune Maharashtra (IN)

(73) Assignee: Halliburton Energy Services, Inc., Houston, TX (US)

( * ) Notice: Subject to any disclaimer, the term of this patent is extended or adjusted under 35 U.S.C. 154(b) by 250 days.

(21) Appl. No.: 14/441,395

(22) PCT Filed: Dec. 11, 2012

(86) PCT No.: PCT/US2012/068983
§ 371 (c)(1),
(2) Date: May 7, 2015

(87) PCT Pub. No.: WO2014/092695
PCT Pub. Date: Jun. 19, 2014

(65) Prior Publication Data
US 2015/0300133 A1 Oct. 22, 2015

(51) Int. Cl.

| | |
|---|---|
| ***E21B 43/08*** | (2006.01) |
| ***E21B 43/10*** | (2006.01) |
| ***E21B 33/12*** | (2006.01) |
| ***E21B 34/06*** | (2006.01) |

(52) U.S. Cl.
CPC ..... *E21B 43/082* (2013.01); *E21B 33/12* (2013.01); *E21B 34/06* (2013.01); *E21B 43/10* (2013.01); *E21B 43/108* (2013.01)

(58) Field of Classification Search
CPC ..... E21B 43/082; E21B 33/12; E21B 43/10; E21B 34/06; E21B 43/108; E21B 43/08
See application file for complete search history.

(56) References Cited

U.S. PATENT DOCUMENTS

| | | | | |
|---|---|---|---|---|
| 5,150,753 | A | 9/1992 | Gaidry et al. | |
| 6,575,251 | B2 | 6/2003 | Watson et al. | |
| 6,675,891 | B2 | 1/2004 | Hailey, Jr. et al. | |
| 6,899,176 | B2 * | 5/2005 | Hailey, Jr. | E21B 34/06 166/232 |
| 7,870,898 | B2 | 1/2011 | Yeh et al. | |
| 2008/0035330 | A1 | 2/2008 | Richards | |
| 2010/0051262 | A1 * | 3/2010 | Dusterhoft | E21B 47/01 166/236 |

(Continued)

FOREIGN PATENT DOCUMENTS

| | | |
|---|---|---|
| WO | 2004099560 A1 | 11/2004 |
| WO | WO2014/092695 | 6/2014 |

OTHER PUBLICATIONS

International Search Report issued by the Korean IPO dated Sep. 4, 2013 regarding PCT/US2012/068983, 3 pages.

(Continued)

*Primary Examiner* — Brad Harcourt
(74) *Attorney, Agent, or Firm* — Haynes and Boone, LLP

(57) ABSTRACT

Disclosed is a screen packer assembly for use in filtering hydrocarbons in a wellbore at a subterranean location. The screen-packer assembly connects in a production tubing string and packs off the wellbore and provides an axial filter path for hydrocarbons through the assembly and into the productions tubing.

20 Claims, 6 Drawing Sheets

(56) References Cited

U.S. PATENT DOCUMENTS

| | | | | |
|---|---|---|---|---|
| 2010/0089565 | A1 | 4/2010 | Duan et al. | |
| 2011/0011577 | A1 | 1/2011 | Dusterhoft et al. | |
| 2011/0067872 | A1* | 3/2011 | Agrawal ..... | E21B 43/082 166/302 |

OTHER PUBLICATIONS

Supplementary European Search Report issued by the European Patent Office regarding EP Application No. 12889866.5, dated Jul. 18, 2016, 7 pages.

* cited by examiner

SCREEN PACKER ASSEMBLY

CROSS REFERENCE TO RELATED APPLICATIONS

This application is a United States national phase application which claims priority to International Application No. PCT/US2012/068983, filed Dec. 11, 2012, the entire disclosure of which is hereby incorporated herein by reference.

BACKGROUND

Technical Field

The present invention relates to filtering undesirable particulates from hydrocarbon production at a subterranean location in a well. In the industry, this field is sometimes referred to as "sand control."

Background Art

Screens and gravel packing are commonly used as a sand-control method to prevent production of formation sand or other fines from a poorly consolidated subterranean formation. In this context, "fines" are tiny particles that have a tendency to flow through the formation with the production of hydrocarbon. The fines have a tendency to plug small pore spaces in the formation and block the flow of oil. As all the hydrocarbon is flowing from a relatively large region around the wellbore toward a relatively small area around the wellbore, the fines have a tendency to become densely packed and screen out or plug the area immediately around the wellbore. Moreover, the fines are highly abrasive and can be damaging to pumping and oilfield other equipment and operations.

In one common type of gravel packing, a mechanical screen is placed in the wellbore and the surrounding annulus is packed with a particulate of a larger specific size designed to prevent the passage of formation sand or other fines.

For sand control applications screens assemblies of various sizes and shapes are used either alone or surrounding by a gravel pack. In a common application configuration a perforated pipe with screen material is connected to a production string installed in the well. Fine gravel material will be flowed (packed) around the screen causing hydrocarbon production to first flow through the gravel pack and then the screen before entering the perforated pipe of the production string.

While these prior filter systems function adequately they can be damaged during installation and use. In addition, problems are encountered with this type of gravel packing in controlling the distribution of particulate around the screen. When voids are present in the gravel pack, the unprotected areas of the screen at the void can be damaged or the area screened out by excessive flow.

SUMMARY OF THE INVENTIONS

In the proposed sand control filter system, gravel and screen material are assembled together in one system and them placed in the well at a subterranean location.

According to one aspect of the present invention, a non-porous tubular member is filled with gravel and screen material and the well is configured to cause the produced hydrocarbon flow to pass through the tubular member.

According to another aspect the present invention, filter zones of gravel of decreasing sizes are included in the tubular member. These gravel zones protect screen material filters in the tubular member.

According to a further aspect of the present invention, the tubular member in the form of a packer that engages the wall of the wellbore to force flow through the filtering material. Indeed, in one embodiment the packer is a swellable packer.

The simple design of "Screen Packer" will be beneficial, in both vertical and horizontal well completion in unconsolidated reservoirs, for sand free production. This can accommodate shorter as well as longer intervals of producing zones. Successful completion using "Screen Packer" could be achieved in a very short period of time.

BRIEF DESCRIPTION OF THE DRAWINGS

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing in which.

DETAILED DESCRIPTION

The present invention provides an improved apparatus and method for filtering hydrocarbons at a subterranean location. The present invention is particularly applicability to using a gravel pack-screen assembly as a filter medium for hydrocarbons being produced from a subterranean formation.

Figure 1:
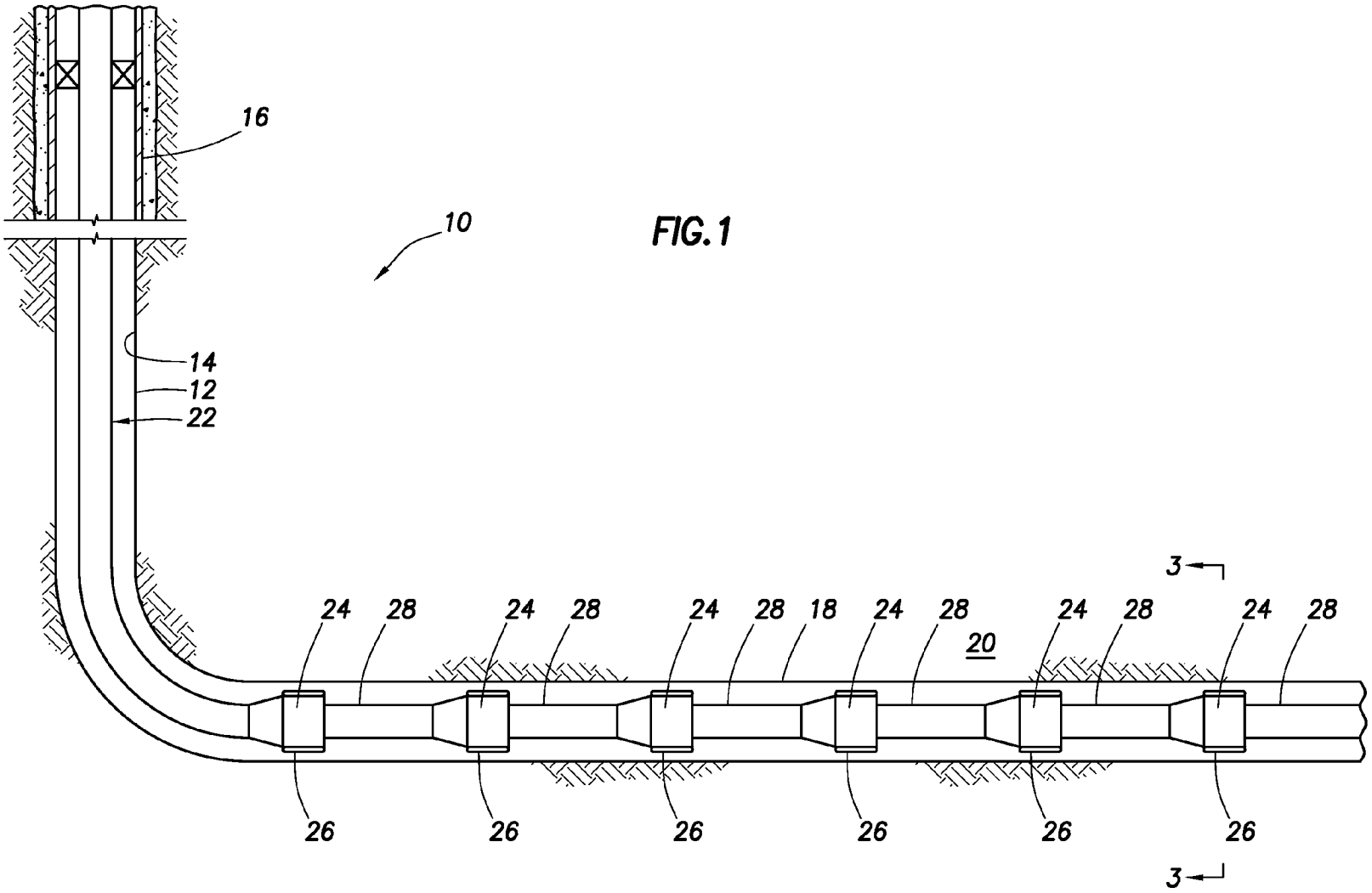
FIG. 1 is a partial section view of a well configuration of the present invention in the run-in configuration illustrated in longitudinal section.

Referring more particularly to the drawings, which are not intended to be to scale or in proportion, wherein, like reference characters are used throughout the various figures to refer to like or corresponding parts, there is shown in FIG. 1, one embodiment of a well screen-packer configuration embodying principles of the present invention that is schematically illustrated and generally designated by reference numeral 10. In the illustrated embodiment, a wellbore 12 extends through various earth strata. Wellbore 12 has a substantially vertical section 14, the upper portion of which has installed therein a casing string 16 that is cemented within the wellbore 12. Wellbore 12, also, has a substantially horizontally extending portion 18 that extends through one or more hydrocarbon bearing subterranean formations 20. In the exemplary embodiment, the wellbore 12 is lined with a casing string. The casing string may then be cemented to the formation. There are a number of factors that go into the decision of whether to case the wellbore 12 and whether to cement the casing to the formation. A person of ordinary skill in the art should know whether the wellbore 12 needs to be cased. In most cases, it will be beneficial to do so. As illustrated, the substantially horizontal section 18 of wellbore 12 is cased and according to the principles of the present invention would apply as well to an open hole completion.

Positioned within wellbore 12, and extending from the surface, is a tubing string 22. Tubing string 22 provides a conduit for formation fluids to travel from the formation 20 the surface. Positioned within tubing string 22 is a plurality of longitudinally spaced sand control packer-screen assemblies 24. The sand control packer screen assemblies 24 are shown in FIG. 1 in a running or un-extended configuration.

Figure 2:
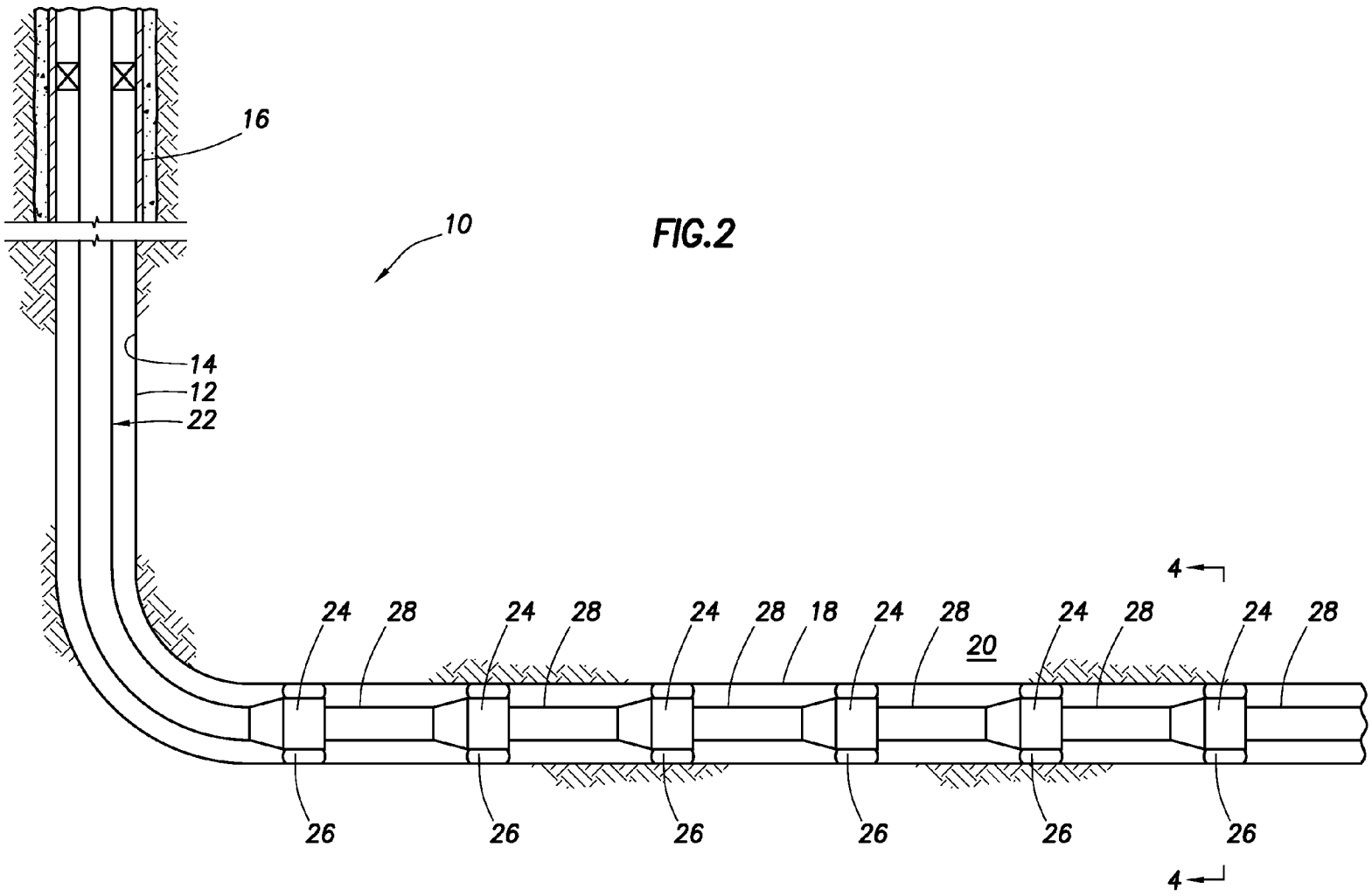
FIG. 2 is a partial view of a well configuration of the present invention in the production configuration illustrated in longitudinal section.

Referring now to FIG. 2, there is depicted well system of FIG. 1 with the sand control packer screen assemblies 24 in their production or expanded configuration. As explained in greater detail below, each of the depicted sand control packer-screen assemblies 22 has a base pipe 28, a filter medium 30 (not illustrated in FIG. 1 or 2) disposed around the base pipe, a sleeve valve (not illustrated in FIG. 1 or 2), and a swellable material layer 26 on the exterior. In general, the swellable material layer is on the exterior or around the circumference of the assembly 22. Also, as will be described in greater detail, hereinafter, the filter medium 30 may comprise a plurality of gravel and screen filter elements arranged in series to filter hydrocarbon fluids, flowing through there through. In this configuration, when the swellable material 26 of assemblies 24 comes into contact with an activating fluid, such as, a hydrocarbon fluid, water or gas, the swellable material layer 26 radially expands to seal against the wall of the wellbore, whether it be cased or open hole. In this manner, the swellable material acts as a packer to pack off the annular space formed between the assembly 24 and the wellbore. It is envisioned, of course, that other packer configurations well known in the art could be utilized, including, for example, those having elastomeric packing elements and optional slip assemblies.

As used herein, a particle is characterized as swellable when it swells upon contact with an aqueous fluid (e.g., water), an oil-based fluid (e.g., oil) or a gas. Suitable swellable particles are described in the following references, each of which is incorporated by reference herein in its entirety: U.S. Pat. No. 3,385,367, U.S. Pat. No. 7,059,415, U.S. Pat. No. 7,578,347, U.S. Pat. App. No. 2004/0020662, U.S. Pat. App. No. 2007/0246225, U.S. Pat. App. No. 2009/0032260 and WO2005/116394.

Even though FIGS. 1 and 2 depict a tubing string the includes only packer screen assemblies 24, those skilled in the art were recognized that tubing string 22 may include a number of other tools and systems such as fluid flow control devices, communication systems, safety systems and the like. Also, tubing string 22 may be divided into a plurality of individuals using zonal isolation devices such as packers. Similar to the swellable material in packer screen assembly 24, the zonal isolation devices may be made from materials that swell upon contact with a fluid such as an inorganic or organic fluid. Some exemplary fluids that may cause the zonal isolation devices to swell and isolate include water, gas and hydrocarbons.

In addition, although not illustrated in FIGS. 1 and 2, one or more production fractures could be formed in or along the horizontal wellbore portion 18, using a variety of techniques. In one exemplary embodiment, a plurality of fractures is formed by using a hydra jetting tool, such as, that used in the SurgiFrac® fracturing service offered by Halliburton Energy Services, Inc. in Duncan, Okla. In this embodiment, the hydra jetting tool forms each fracture, one at a time. Each fracture may be formed by the following steps: (i) positioning the hydra jetting tool in the wellbore at the location where the fracture is to be formed, (ii) perforating the reservoir at the location where the fracture is to be formed, and (iii) injecting a fracture fluid into the perforation at sufficient pressure to form a fracture along the perforation. As those of ordinary skill in the art will appreciate, there are many variations on this embodiment. For example, fracture fluid can be simultaneously pumped down the annulus while it is being pumped out of the hydra jetting tool to initiate the fracture. Alternatively, the fracturing fluid may be pumped down the annulus and not through the hydra jetting tool to initiate and propagate the fracture. In this version, the hydra jetting tool primarily forms the perforations.

The fractures 210 may take a variety of geometries, but preferably the fractures extend transverse to the wellbore so that the fractures extend at a substantially right angle with respect to the wellbore longitudinal axis. In some embodiments, the fractures may be formed along natural fracture lines and may generally be parallel to one another. The fracture's shape, size and orientation can be determined by the orientation of the fluid nozzles and movement thereof. Using hydrajetting radially from a vertical wellbore, a transversely extending fracture can be formed and may extend from about 50 ft to about 1000 ft from the wellbore.

Figure 3:
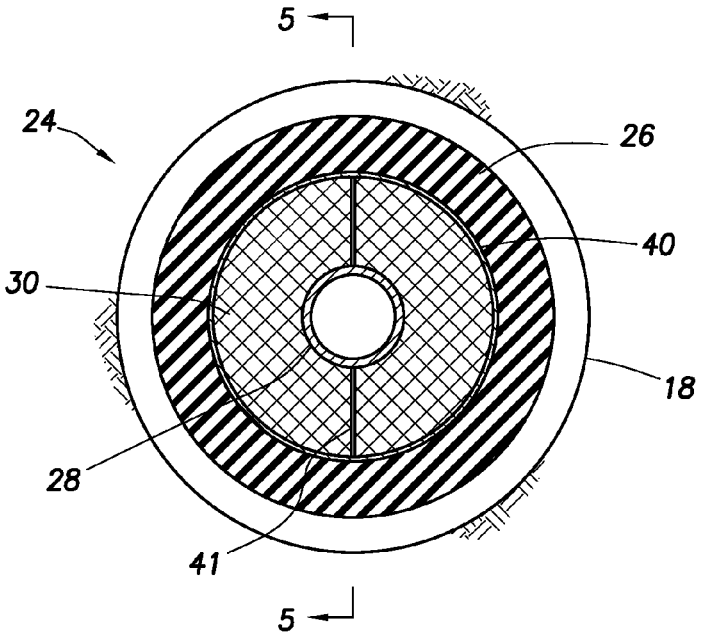
FIG. 3 is an enlarged sectional view taken on line 3-3 in FIG. 1 looking in the direction of the arrows of the screen packer assembly of the present invention in the run-in configuration.
Figure 4:
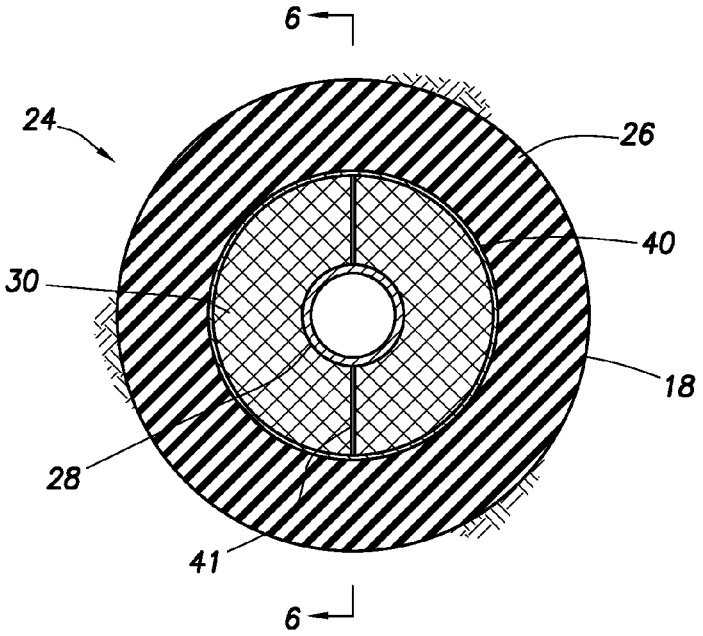
FIG. 4 is an enlarged sectional view taken on line 4-4 in FIG. 2 looking in the direction of the arrows of the screen packer assembly of the present invention the production configuration.
Figure 5:
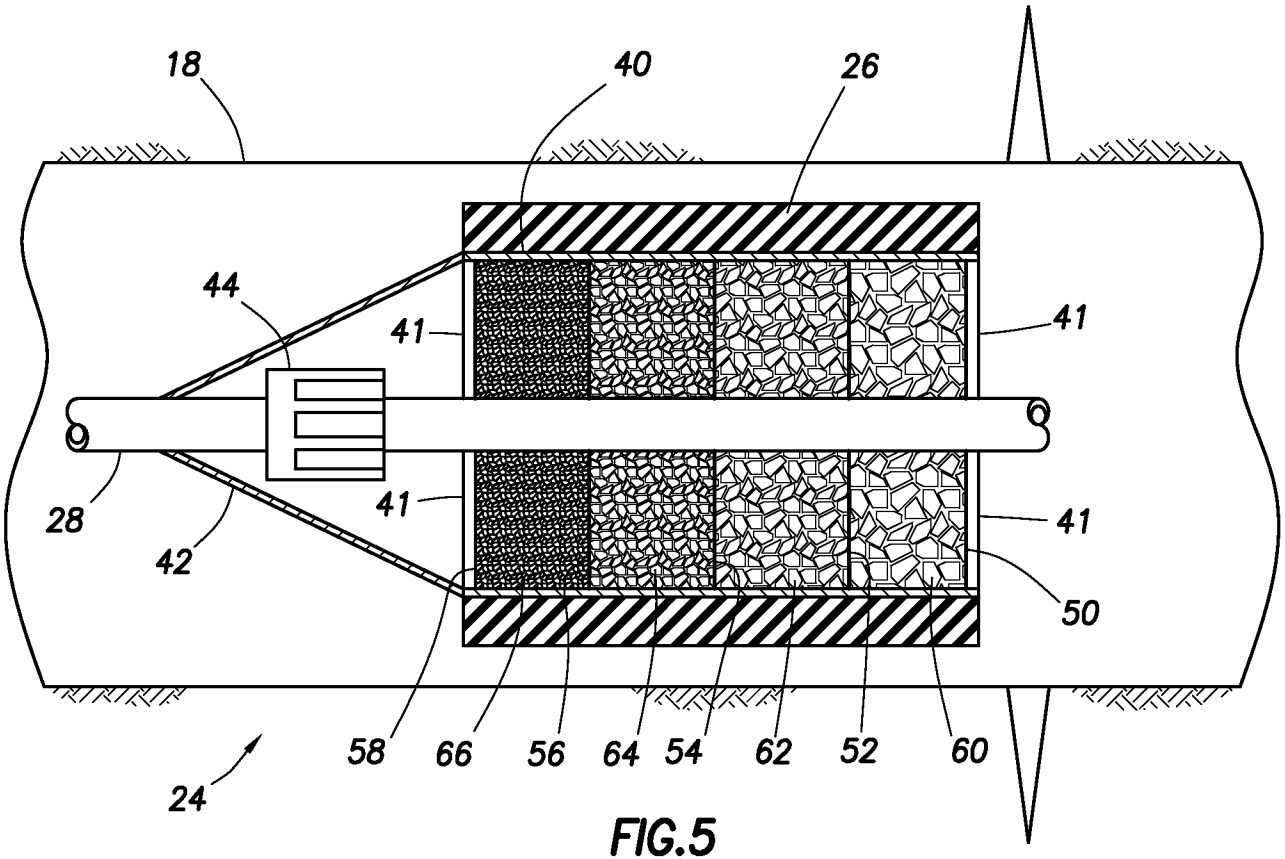
FIG. 5 is an enlarged sectional view taken on line 5-5 in FIG. 3 looking in the direction of the arrows of the screen packer assembly of the present invention in the run-in configuration.
Figure 6:
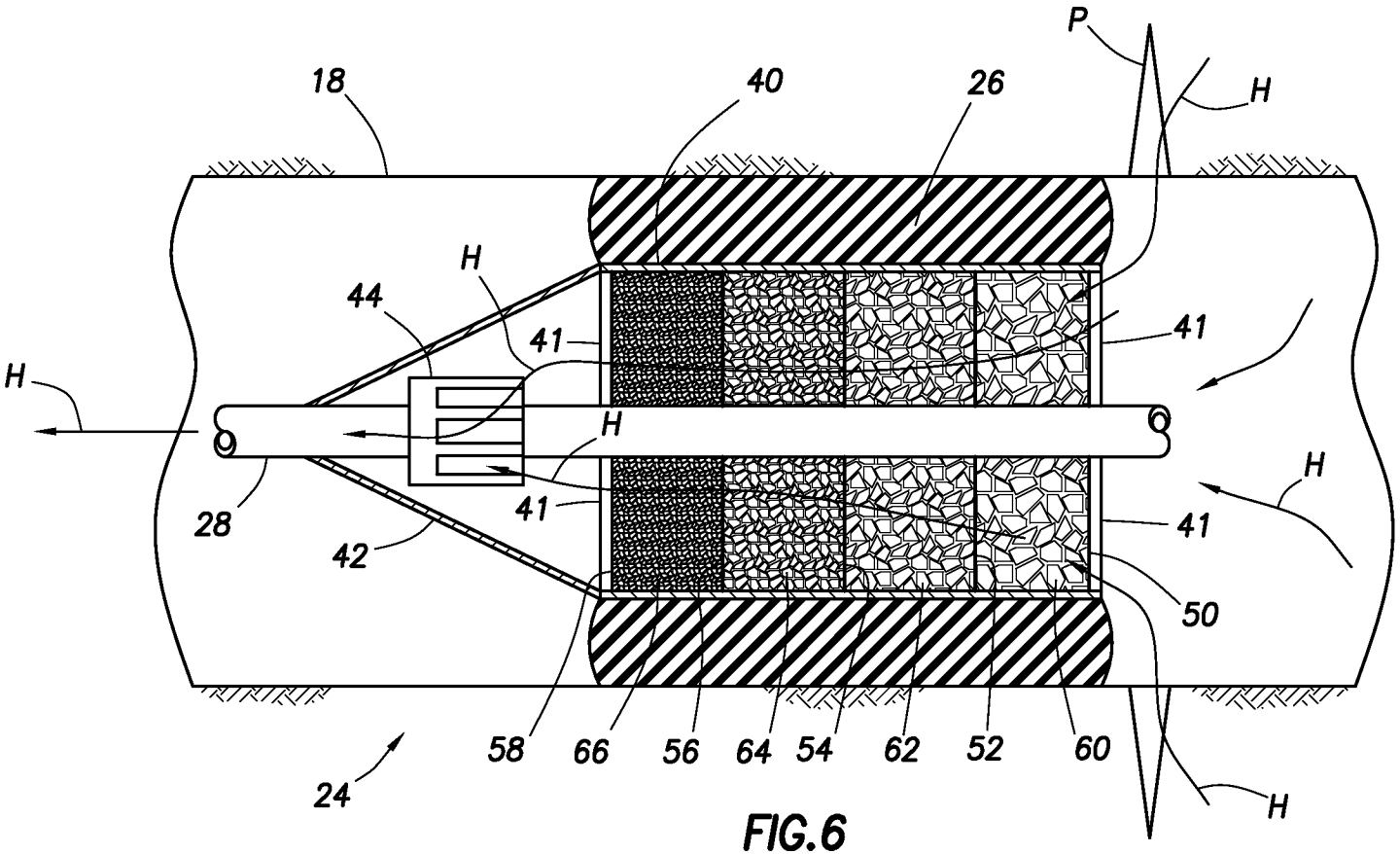
FIG. 6 is an enlarged sectional view taken on line 6-6 in FIG. 4 looking in the direction of the arrows of the screen packer assembly of the present invention the production configuration.

In addition, even though FIGS. 1 and 2 illustrate the packer screen assemblies of the present invention in a horizontal section of the wellbore, it should be understood by those skilled in the art, that the sand control screen assemblies of the present invention are equally well-suited for use in deviated or vertical wellbores. Accordingly, it should be understood by those skilled in the art, that the use of directional terms such as above, below, upper, lower, upward, downward and the like, are used in relation to the illustrative embodiments as they are depicted in the figures, the upward direction being toward the top of the corresponding figures in a downhole direction being toward the bottom of the corresponding figure. Likewise, even though FIGS. 1 and 2 depict the packer screen assemblies of the present invention in a wellbore having a single wellbore, it should be understood by those skilled in the art, that the packer screen assemblies of the present invention are equally well-suited for use in multilateral wellbores having a main wellbore in a plurality of branch wellbores. Turning now to FIGS. 3-6, the details of the illustrated embodiment of the packer screen assemblies 24 will be described. In FIGS. 3 and 5 the packer screen assembly 24 is illustrated in this run configuration. In FIGS. 4 and 6 the packer screen assembly is illustrated in its production configuration. In FIG. 3, swellable material 26 is illustrated prior to its being contacted by activating fluid. In this configuration, an annular space is present between the exterior of the swellable material 26 and the interior of the wellbore 18 allowing the assembly to be placed in the well. In FIG. 4, the swellable material 26 is shown after it has been contacted by an activating fluid with the material 26 expanded to pack off the annular space around the assembly 24.

In FIG. 6, the flow of hydrocarbons "H" into the wellbore and through the assembly 24, is illustrated by arrows. Hydrocarbons "H" flow into the wellbore 18 through a plurality of perforations "P". As will be described in detail, the flow then filtered as it passes through the assembly 24 and thereafter enters the base pipe 28 through a valve 44.

As illustrated, the packer screen assemblies 24 comprise a rigid tubular housing 40 mounted in spaced concentric relationship with the base pipe 28. Swellable material 46 is mounted or bonded to the exterior of the tubular housing 40. One or more supports 41 can be provided to connect housing 42 the base pipe 28. In the illustrated embodiment supports 41 were in the form of spokes, however, it is envisioned that the supports 41 could be in the form of ribs, screens or porous annular walls.

Positioned inside of the housing 40 is a plurality of longitudinally spaced annular screens 50, 52, 54, 56, and 58. These screens are connected to the interior surface of the housing 40 and the exterior surface of the base pipe 28 in such a manner that flow around the edges is prevented. It is envisioned that welding clamps are other means could be utilized to attach the screens to the base pipe and housing. According to a particular feature, the present invention is envisioned that the screens 50-58 with vary in pore size with the coarsest screen.

In the illustrated embodiment a plurality of gravel packs 60, 62, 64 and 66 are positioned between the screens 50-58. According to another particular feature of the present invention, the particulate material of the gravel packs 60-66 also vary in coarseness, with the gravel pack 60 being the coarsest and 66 being the finest. It is envisioned that by causing a hydrocarbon to flow successively through varying coarseness of screens and gravel packs that the filtering process will be more efficient. Is it believed that the coarser particulate contaminants in the flowing hydrocarbon will be filtered out in the initial portion of flow through the assembly 24 leaving the finer portions to be filtered out in the subsequent flow portions. This is also believed to prevent damage to the finer screens.

For example:

| Pack Sand US Mesh | Smallest Gravel Size (US Mesh) | Pack Sand Smallest Diameter (inches) | Screen Gauge Size (inches) |
|---|---|---|---|
| 8/12 | 12 | 0.0661 | 0.061 |
| 10/16 | 16 | 0.0469 | 0.042 |
| 12/20 | 20 | 0.331 | 0.028 |
| 16/30 | 30 | 0.0232 | 0.018 |
| 20/40 | 40 | 0.0165 | 0.012 |
| 30/50 | 50 | 0.0117 | 0.007 |
| 40/60 | 60 | 0.0098 | 0.005 |
| 50/70 | 70 | 0.0083 | 0.003 |

An enclosure 42 is formed by a conical shaped wall extending from the housing 40 to the exterior of the base pipe 28. This enclosure is in fluid communication with the hydrocarbons following through the assembly 24 and encloses the valve 44.

Figure 7:
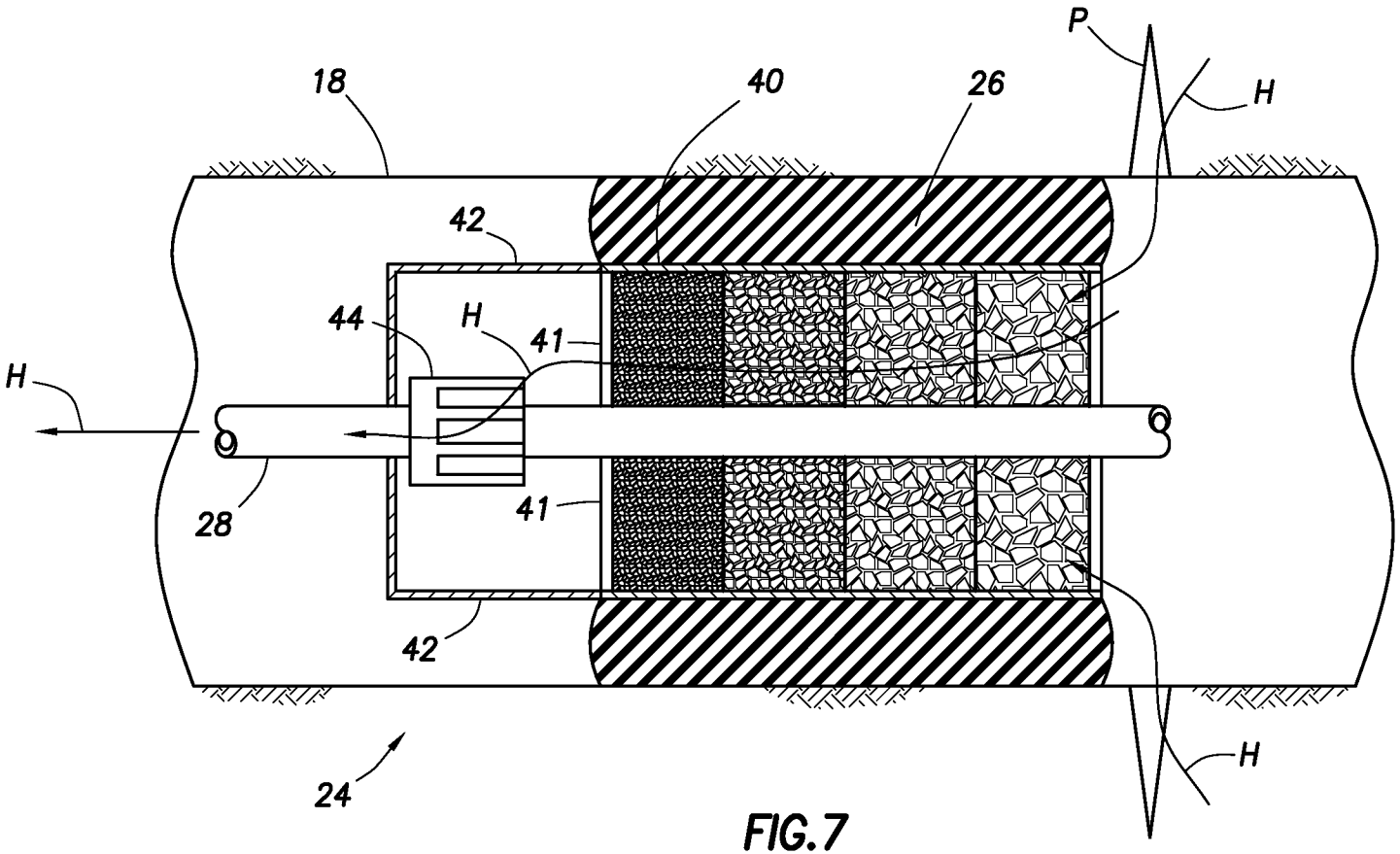
FIG. 7 is an enlarged sectional view similar FIG. 6 illustrating an alternative embodiment.

In another embodiment illustrated in FIG. 7, the enclosure 42*a* is formed within the housing 40.

In the illustrated embodiment the valve 44 is a sleeve type valve that can be opened or closed to allow hydrocarbon liquids to selectively flow into the base pipe 28. The sleeve valve 44 is of the type which can be opened or closed by accessing the base pipe in any manner well known in the art, such as, by use of a wireline, a service string, acoustic signal, RF signals, or the like. It is envisioned, of course, that this valve could be of a different type valve, such as, a ball, gate or other type valve.

In alternative embodiment, only screens 50 and 58 would be present and the gravel in the housing positioned between the two screens would be of uniform size and coarseness.

In a further embodiment, only screens 50 and 58 would be present in the gravel between the screens would be layered in decreasing coarseness as illustrated in FIG. 6.

In additional embodiments, with only the final screens 58 present in the housing 40, could also have gravel of either uniform coarseness or layered in decreasing coarseness as described above.

In an even further embodiment, no screens would be present with the hydrocarbon filtered only by the gravel pack configuration as described above.

In any of the above described embodiments, the gravel layer or layers could be consolidated by a polymer, as is well known in the industry.

In any of the above described embodiments, the gravel could be coated by any materials that enhance filtering, such as the product available from Halliburton under the trademark "Sand Wedge."

While compositions and methods are described in terms of "comprising," "containing," or "including" various components or steps, the compositions and methods, also, can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned, as well as, those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

The invention claimed is:

1. A hydrocarbon fluid filtering apparatus for connection to production tubing in a wellbore at a subterranean location, the apparatus comprising:

a tubular member configured to connect to the production tubing;

a longitudinally extending housing mounted outside the tubular member, the member being of a size to form an annular space between the tubular member and the housing and of a size to fit in the wellbore;

walls forming a chamber on one end of the housing, wherein the chamber is in fluid communication with the interior of the housing and the interior of the tubular member;

packing on the exterior of the housing; and a filter in the annular space between the tubular member and the housing, whereby hydrocarbon fluids flowing axially along the wellbore through the annular space flow through the filter.

2. The hydrocarbon fluid filtering apparatus of claim 1, additionally comprising a valve selectively providing fluid communication for hydrocarbon fluids exiting the annular space to enter the tubular member.

3. The hydrocarbon fluid filtering apparatus of claim 2, wherein the valve is located in the chamber.

4. The hydrocarbon fluid filtering apparatus of claim 1, wherein the packing on the exterior of the housing comprises swellable material.

5. A hydrocarbon fluid filtering apparatus claim 1, wherein the filter in the annular space between the tubular member and the housing comprises a screen.

6. The hydrocarbon fluid filtering apparatus of claim 1, wherein the filter in the annular space between the tubular member and the housing comprises particulate material.

7. The hydrocarbon fluid filtering apparatus of claim 1, wherein the filter in the annular space between the tubular member and the housing comprises a screen and particulate material.

8. The hydrocarbon fluid filtering apparatus of claim 1, wherein the filter in the annular space between the tubular member and the housing comprises a plurality of screens of different pore size.

9. The hydrocarbon fluid filtering apparatus of claim 8, wherein the plurality of filters in the annular space between the tubular member and the housing vary in pore size progressively from coarse to finer in the direction of hydrocarbon flow through the apparatus.

10. The hydrocarbon fluid filtering apparatus of claim 1, wherein the filter in the annular space between the tubular member and the housing comprises particulate material.

11. The hydrocarbon fluid filtering apparatus of claim 1, wherein the filter in the annular space between the tubular member and the housing comprises layers of particulate material of different particulate sizes.

12. The hydrocarbon fluid filtering apparatus of claim 11, wherein the plurality of layers of particulate material of different particulate sizes vary in size progressively from the largest to the smallest in the direction of hydrocarbon flow through the apparatus.

13. A method of producing filtered fluid hydrocarbons from a well penetrating a subterranean hydrocarbon bearing formation, comprising the steps of:

providing a filtering apparatus comprising:

a tubular non porous housing; and a filter in the interior of the tubular non porous housing;

connecting the filtering apparatus to an interior tubular member; wherein an annular space is formed between the interior tubular member and the tubular non-porous housing; wherein the filter is positioned in the annular space;

positioning the filtering apparatus and the interior tubular member in the wellbore at a subterranean location;

contacting a wellbore wall with the filtering apparatus to block flow of hydrocarbon fluids between the wellbore wall and the housing;

filtering hydrocarbon fluids flowing into the wellbore from the subterranean hydrocarbon bearing formation by passing the hydrocarbon fluids through the filter positioned in the annular space; and flowing the filtered hydrocarbon fluids into the interior tubular member.

14. The method of producing filtered fluid hydrocarbons from a well penetrating a subterranean hydrocarbon bearing formation according to claim 13 wherein the contacting the wellbore wall step comprises expanding swellable material located on the outside of the tubular non porous housing.

15. The method of producing filtered fluid hydrocarbons from a well penetrating a subterranean hydrocarbon bearing formation according to claim 13 wherein the filter of the filtering apparatus comprises a screen.

16. The method of producing filtered fluid hydrocarbons from a well penetrating a subterranean hydrocarbon bearing formation according to claim 13 wherein the filter of the filtering apparatus comprises a plurality of screens of different pore sizes.

17. The method of producing filtered fluid hydrocarbons from a well penetrating a subterranean hydrocarbon bearing formation according to claim 16, wherein the plurality of filters in the annular space between the interior tubular member and the tubular non porous housing vary in pore size progressively from coarse to a smaller size in the direction of hydrocarbon flow through the filtering apparatus.

18. The method of producing filtered fluid hydrocarbons from a well penetrating a subterranean hydrocarbon bearing formation according to claim 13 wherein the filter of the filtering apparatus comprises particulate material.

19. The method of producing filtered fluid hydrocarbons from a well penetrating a subterranean hydrocarbon bearing formation according to claim 13 wherein the filter of the filtering apparatus comprises layers of particulate material of different particulate sizes.

20. The method of producing filtered fluid hydrocarbons from a well penetrating a subterranean hydrocarbon bearing formation according to claim 19 wherein the plurality of layers of particulate material of different particulate sizes vary in size progressive from the largest to the smallest in the direction of hydrocarbon flow through the filtering apparatus.

* * * * *